US009586112B2

(12) United States Patent
Sola et al.

(10) Patent No.: US 9,586,112 B2
(45) Date of Patent: Mar. 7, 2017

(54) ICE HOCKEY GOALIE STICK AND METHOD FOR MAKING SAME

(71) Applicant: Sport Maska Inc., Montreal (CA)

(72) Inventors: Matthieu Sola, Montreal (CA); Eric Allard, St-Hubert (CA); Travis Downing, Carlsbad, CA (US)

(73) Assignee: SPORT MASKA INC., Montreal (CA)

( * ) Notice: Subject to any disclaimer, the term of this patent is extended or adjusted under 35 U.S.C. 154(b) by 0 days.

(21) Appl. No.: 14/808,559

(22) Filed: Jul. 24, 2015

(65) Prior Publication Data

US 2017/0021243 A1 Jan. 26, 2017

(51) Int. Cl.
*A63B 59/14* (2006.01)
*A63B 59/00* (2015.01)

(52) U.S. Cl.
CPC ..... *A63B 59/0092* (2013.01); *A63B 59/14* (2013.01); *A63B 59/70* (2015.10); *A63B 60/54* (2015.10); *A63B 2102/24* (2015.10)

(58) Field of Classification Search
CPC . A63B 59/70; A63B 2102/22; A63B 2102/24; A63B 60/06; A63B 60/08; A63B 60/54; A63B 60/14
USPC ..... 473/560–563
See application file for complete search history.

(56) References Cited

U.S. PATENT DOCUMENTS 1,183,473 A * 5/1916 McNiece ..... A63B 59/70 473/560
1,687,736 A * 10/1928 Root ..... A63B 60/10 473/560
4,340,224 A * 7/1982 Staats ..... A63B 59/70 473/563
4,544,157 A * 10/1985 Curtis ..... A63B 59/70 473/560
5,122,405 A 6/1992 Landi
5,333,857 A 8/1994 Lallemand
5,456,463 A * 10/1995 Dolan ..... A63B 59/70 473/563
5,863,268 A * 1/1999 Birch ..... A63B 59/70 423/562

(Continued)

FOREIGN PATENT DOCUMENTS

CA 2818543 A1 12/2014
CN 1640514 A 7/2005
WO 2005069908 A2 8/2005

OTHER PUBLICATIONS

Reebok, Premier Goalie Stick, Reebok-CCM, http://reebokhockey.com/en/gear/goalie/sticks/premier-goalie-stick, 2013.

(Continued)

*Primary Examiner* — Mark Graham
(74) *Attorney, Agent, or Firm* — Norton Rose Fulbright Canada LLP

(57) ABSTRACT

An ice hockey goalie stick and method for making same is disclosed. The ice hockey goalie stick includes a shaft having an outer surface and extending along a longitudinal axis between a first end and an opposed second end. A paddle is mounted to the shaft at the second end, the paddle extending along the longitudinal axis and terminating in a blade. A dampening element is disposed over the shaft along at least a partial length of the second end thereof, the dampening element being made of a vibration-dampening material.

23 Claims, 3 Drawing Sheets

(56) References Cited

U.S. PATENT DOCUMENTS

| | | | | |
|---|---|---|---|---|
| D406,625 | S * | 3/1999 | Hutzenlaub | D21/727 |
| 6,099,421 | A * | 8/2000 | Mayhew | A63B 59/70 473/560 |
| D431,621 | S * | 10/2000 | Pagotto | D21/727 |
| 6,625,848 | B1 | 9/2003 | Schneider | |
| D496,703 | S * | 9/2004 | Gans | D21/727 |
| 6,953,405 | B2 | 10/2005 | LeMire et al. | |
| 7,282,001 | B2 * | 10/2007 | Ponzini | A63B 59/70 473/560 |
| 7,329,195 | B2 | 2/2008 | Pearson | |
| 7,556,573 | B2 * | 7/2009 | Beach | A63B 69/0024 473/422 |
| 8,608,597 | B2 | 12/2013 | Avnery | |
| 9,101,804 | B2 * | 8/2015 | Brenner | A63B 59/0014 |
| 2002/0094891 | A1 * | 7/2002 | Horwood | A63B 59/70 473/560 |
| 2003/0084756 | A1 * | 5/2003 | Schroder | B25G 1/01 81/20 |
| 2005/0137037 | A1 * | 6/2005 | Tucker | A63B 49/08 473/513 |
| 2006/0281591 | A1 * | 12/2006 | Wikstrom | A63B 59/70 473/560 |
| 2010/0323830 | A1 * | 12/2010 | Blotteaux | A63B 49/14 473/563 |
| 2012/0202625 | A1 * | 8/2012 | McGibbon | A63B 59/70 473/561 |
| 2014/0315669 | A1 * | 10/2014 | Jeanneau | A63B 59/14 473/563 |
| 2015/0072809 | A1 * | 3/2015 | Palumbo | A63B 59/14 473/560 |

OTHER PUBLICATIONS

True, True Goalie A6.0, True temper hockey, http://www.true-hockey.com/products/goalie-sticks/true-goalie-a6.0, 2015.

Mercian, 2014/2015 Pro-Line, http://www.mercianhockey.com/products/sticks/pro-line/.

* cited by examiner

ICE HOCKEY GOALIE STICK AND METHOD FOR MAKING SAME

TECHNICAL FIELD

The present disclosure relates generally to hockey sticks and, more particularly, to a goalie stick used in ice hockey.

BACKGROUND

Ice hockey sticks provide a player with the means to control the puck and to direct it along a particular direction. Some ice hockey sticks, such as those used by goaltenders, serve a more defensive role whereby their primary purpose is to block or deflect the hockey puck.

The impact of the puck against the goalie stick may cause the player, in this case the goaltender (or "goalie"), to experience vibrations. The goalie absorbs vibrations through the hand gripping the goalie stick. Absorbing vibrations may cause discomfort. Furthermore, after repeated impacts over the course of multiple periods, the goalie's hand may become fatigued from absorbing the vibrations, causing her/him to potentially lose control of the goalie stick or to less effectively re-direct shots directed toward the stick.

Many ice hockey players, including goalies, now use hockey sticks made completely of a polymer composite. While such polymer composite goalie sticks are generally lighter than more traditional wooden sticks, they are more responsive to vibration than wood or wood-composite goalie sticks and therefore are particularly susceptible to the phenomenon of vibration transition through the stick to the hand of the goalie.

An improved goalie stick for use in ice hockey is therefore sought.

SUMMARY

In one aspect, there is provided an ice hockey goalie stick, comprising: a shaft extending along a longitudinal axis between a first end and an opposed second end, the shaft having an outer surface; a paddle mounted to the shaft at said second end, the paddle extending along the longitudinal axis and terminating in a blade; and a dampening element disposed over at least a portion of the shaft, the dampening element surrounding at least a partial length of the second end of the shaft, the dampening element being made of a vibration-dampening material and covering the outer surface along said partial length of the second end of the shaft.

In another aspect, there is provided a method for making an ice hockey goalie stick, comprising: covering at least a partial length of a shaft with a dampening element, the dampening element being made of a vibration-dampening material; surrounding at least part of dampening element on the shaft with a paddle; and joining the paddle to at least one of the dampening element and the shaft.

In a further aspect, there is provided an ice hockey goalie stick, comprising: a shaft having an outer surface and extending along a longitudinal axis between a first end and an opposed second end, the shaft having a handle portion proximate to the first end and an adjacent intermediate portion, the intermediate portion having a dampening element extending over the outer surface of the shaft along at least a portion of a length of the intermediate portion, the dampening element being made of a vibration-dampening material, the vibration-dampening material covering said at least a portion of the length of the intermediate portion of the shaft; and a paddle extending along the longitudinal axis and terminating in a blade, the paddle connected to the intermediate portion of the shaft.

BRIEF DESCRIPTION OF THE DRAWINGS

Reference is now made to the accompanying figures in which.

DETAILED DESCRIPTION

Figure 1:
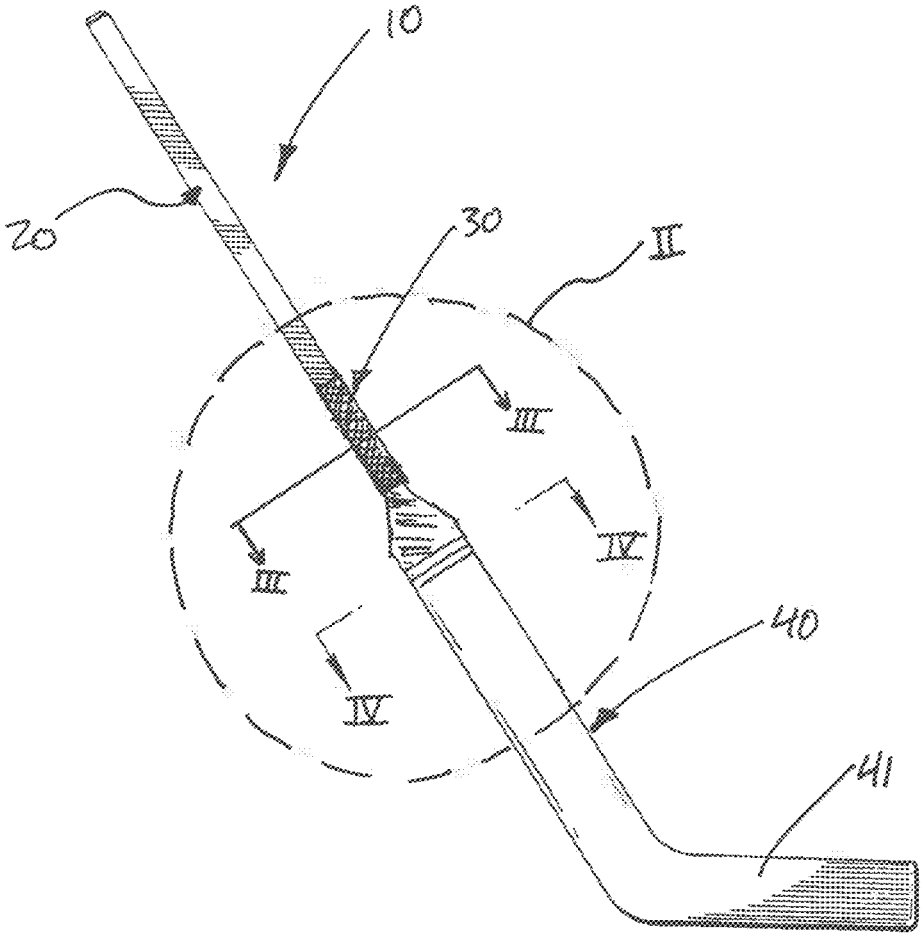
FIG. 1 is a perspective view of an ice hockey goalie stick, according to an embodiment of the present disclosure.
Figure 2:
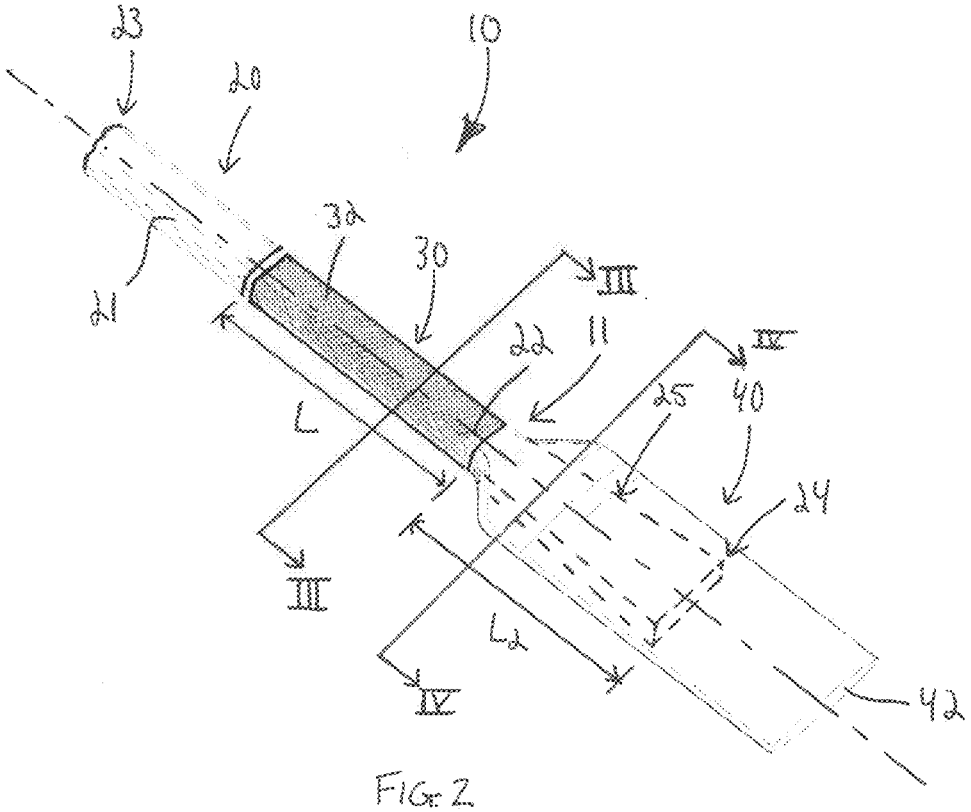
FIG. 2 is an enlarged perspective view of the ice hockey goalie stick of FIG. 1, taken from region II in FIG. 1.

FIGS. 1 and 2 illustrate a hockey stick of the type used by goaltenders (or simply "goalies") in the sport of ice hockey. More particularly, FIGS. 1 and 2 illustrate an ice hockey goalie stick 10. The goalie stick 10 is used by goaltenders to block pucks directed at the goal protected by the goalie, to deflect pucks away from the goal, and occasionally to play the puck when required. While the primary role of the goalie stick 10 (or simply "stick 10") is to block pucks from entering the goal, it can therefore also be used to pass the puck to another player, or used by the goalie herself/himself to make a shot on an opponent's goal.

The stick 10 disclosed herein is formed a multi-part stick 10 which can be made as described below. In the embodiments shown, the stick 10 is three-part goalie stick 10. The stick 10 as described herein may help to reduce and/or eliminate vibrations experienced by the goalie when the stick 10 is impacted by the puck. In so doing, the stick 10 may help to improve the comfort of the goalie when using the stick 10, and may also contribute to reducing the fatigue experienced by the hand of the goalie due to vibrations caused by impacts from the puck. Additionally, the stick 10 as described herein may be found to give the player better control over the stick, thereby potentially helping improve performance of the player.

The goalie stick 10 has a shaft 20 which is gripped by the goalie to manipulate the stick 10, and a dampening element 30 covering an outer surface 21 of the shaft 20. The dampening element 30 can be gripped by the goalie and helps to reduce, or dampen, vibrations caused by the impact of the puck against the stick 10. The goalie stick 10 also has a paddle 40 which includes a blade 41 at the remote distal end thereof (i.e. further away from the 20) and which surrounds at least some part of the dampening element 30 and the shaft 20 at the proximal end thereof (i.e. closer to the shaft 20).

Referring now to FIGS. 2 to 5, the shaft 20 is an elongated body and forms the corpus of the stick 10. The shaft 20 extends along a longitudinal axis 22 between a first end 23 and a second end 24. When the stick 10 is used, the goalie typically handles the shaft 20 at its first end 23 with one or more hands in order to manipulate the stick 10 and direct it and the paddle 40. The portion of the shaft 20 near the first end 23 is therefore a handle portion. The shaft 20 typically has a substantially rectangular cross-sectional shape, although other cross-sectional shapes are possible. In some embodiments, the shaft 20 is a hollow body, and thus has an empty interior cavity defined within an outer shell of the shaft. This reduces the overall weight of the stick 10, which improves the ability of the goalie to manipulate it. It will be appreciated that a shaft 20 having a full body is also within the scope of the present disclosure, as are sticks made of a number of different materials, including but not limited to, wood and composite materials. Additionally, the shaft 20 may be only partially hollow at certain portions thereof, whereby the shaft 20 is partially solid in some regions and partially hollow in other regions. In yet another possible embodiment, the shaft 20 may be formed by an outer shell defining one or more cavities therewithin, and wherein the cavity or cavities are partially or fully filled by a foam material encapsulated within the outer shell.

In this embodiment, the shaft 20 extends into the paddle 40 such that a length of the shaft 20 to the second end 24 is within the paddle 40. This portion of the shaft 20 is the covered portion 25 because it is surrounded at least by the paddle 40. The covered portion 25 of the shaft 20 helps to reinforce the paddle 40, which is generally a hollow body, and contributes to the overall structural integrity of the stick 10. The covered portion 25 also helps to connect the shaft 20 to the paddle 40, as explained in great detail below. It will be appreciated, however, that other embodiments of the stick 10 include a shaft 20 which does not extend into the paddle 40, and which does not have a covered portion 25.

The dampening element 30 extends over the outer surface 21 of the shaft 20 along a length L of the shaft 20. The dampening element 30 is located on a section of the stick 10 that is typically gripped by one of the hands of the goalie. The section of the stick may be referred to as the "shoulder" 11, which denotes the intersection of the shaft 20 with the wider paddle 40. The dampening element 30 is therefore along an intermediate portion of the shaft 20 (i.e. between the handle portion of the shaft 20 near the first end 23, and the paddle 40). The dampening element 30, in being positioned between the outer surface 21 of the shaft 20 and the hand of the goalie, helps to dampen or reduce the vibration felt by the goalie's hand due to impacts by the puck. Stated differently, the vibrations caused by the impact of the puck on the stick 10 are reduced by the dampening element 30 before they are felt by the goalie's hand.

The dampening element 30 therefore includes, or is made of, a vibration-dampening material 32. The vibration-dampening material 32 covers or envelops the outer surface 21 of the shaft 10 over the length L of the shaft 20. When a puck impacts the stick 10, the vibration-dampening material 32 dampens a level of vibrational energy as a result of its ability to dissipate energy, thereby reducing the vibration energy felt by the goalie's hand. It will therefore be appreciated that many possible vibration-dampening materials 32 capable of the above-described functionality are within the scope of the present disclosure.

The vibration-dampening material 32 may be a rubber material. In such an embodiment, the dampening element 30 may be a rubber sleeve which covers the outer surface 21 of the shaft 20 over the length L. The vibration-dampening material 32 may also be a suitable polymer coating, which is applied over the outer surface 21 along the length L of the shaft 20. Other materials may also be used.

Regardless of the material selected for the vibration-dampening material 32, a number of means for attaching the dampening element 30 to the outer surface 21 of the shaft 20 can be used. Some non-limiting examples include the use of an adhesive to adhere the dampening element 30 to the outer surface 21 of the shaft 20, and the use of a co-molding or over-molding processes to form the dampening element 30 on the shaft 20. It is to be understood, however, that the dampening element 30 does not need to be permanently (or non-removably) attached to the shaft 20, such as by bonding, molding or adhere the components together. In an alternate embodiment, the dampening element 30 is in fact removably-engaged about the outer surface 21 of the shaft, such as to enable the dampening element 30 to be removed when required. This embodiment permits the dampening element 30 to be replaced if/when necessary, and/or to switch one dampening element 30 for another (having, for example, a vibration-dampening material and/or different material properties such as a different degree of resilience). This embodiment therefore permits the player to switch between several different sleeves forming the dampening element 30, in order for example to select between different levels of shock absorption—and therefore find the preferred balance for the specific player between control and shock/vibration-absorption, for example.

In addition to its dampening characteristics, the vibration-dampening material 32 may impart other functional characteristics. For example, the vibration-dampening material 30 may be textured, or its inherent material properties may be such as to increase the frictional engagement between the hand of the goalie and the dampening element 30. This improves the goalie's grip of the shaft 20, and of the stick 10.

The length L over which the dampening element 30 extends over the outer surface 21 may vary. For example, as more clearly seen in FIG. 2, the length L of the dampening element 30 may include the shoulder portion of the stick 10, and also extends a distance toward the first end 23 to allow the goalie to grip the dampening element 30 at multiple points. The length L may be shorter or longer than that shown in FIG. 2. In one particularly embodiment, although not necessarily in all possible embodiments of the present disclosure, the dampening element 30 can extend an additional length $L_2$ into the paddle 40. The dampening element 30 extending over additional length $L_2$ covers the outer surface 21 of the covered portion 25 of the shaft 20 within the paddle 40. This may help to reinforce the structural integrity of the stick 10 by helping to secure the paddle 40 to the shaft 20 along a greater length of the shaft 20.

The dampening element 30 may also extend over an exterior of the paddle 40 in the vicinity of the shoulder 11. When the goalie uses the stick 10, she/he may extend one or more fingers across the shoulder 11 and onto the exterior surface of the paddle 40 to improve their control of the stick 10. In covering this area of the exterior of the paddle 40, the dampening element 30 provides vibration dampening to these fingers or parts of the hand that may extend downward from the shoulder 11 onto the outer surface of the paddle 40.

Figure 5:
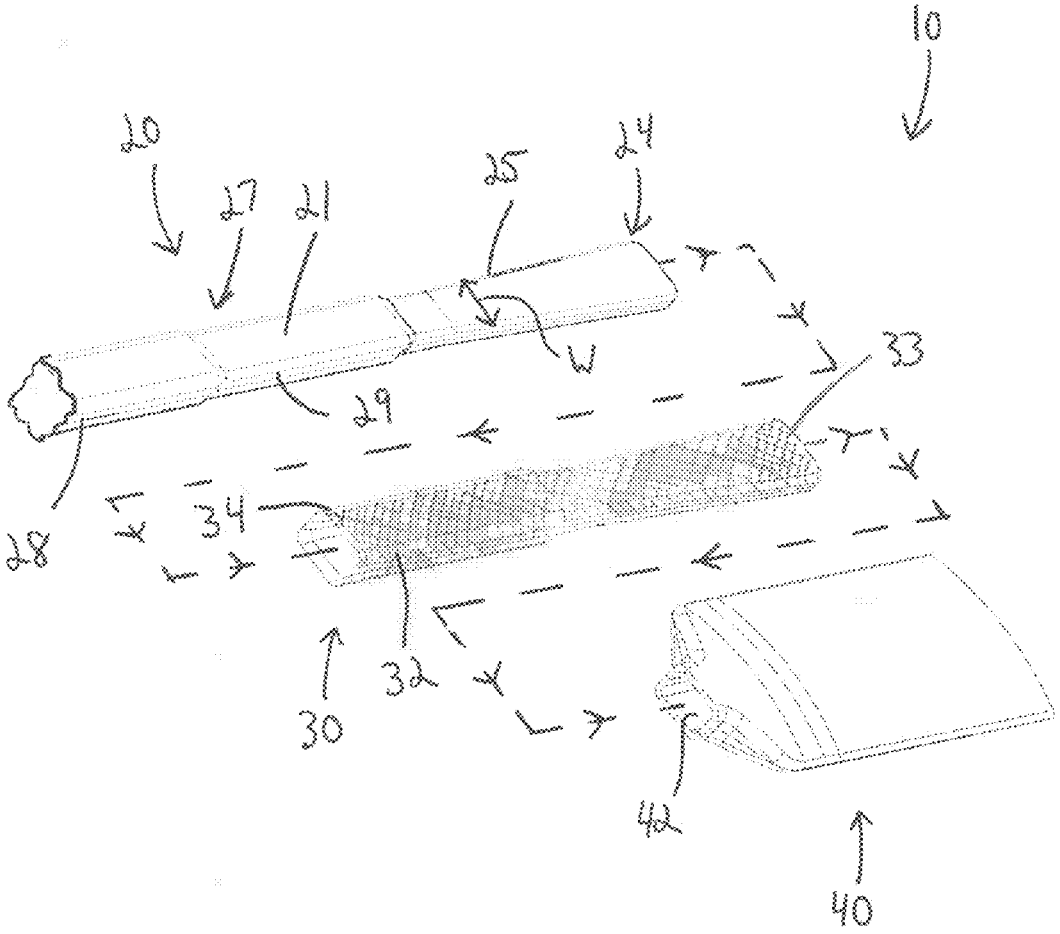
FIG. 5 is an exploded perspective view of the ice hockey goalie stick of FIG. 2.

The paddle 40 is the widest portion of the stick 10 and is used by the goalie to deflect or block the puck. The paddle 40 is an elongated body extending along the longitudinal axis 22. It is generally thickest at its center (i.e. in proximity to the longitudinal axis 22), and narrows towards its side extremities. As with the shaft 10, the paddle 40 may be hollow along some or all of its length. The paddle 40 may therefore be entirely solid, entirely hollow, or a combination thereof, including for example being partially hollow and/or filled with a foam. FIGS. 2 and 5 show only part of the paddle 40, and it will be appreciated that the end of the paddle 40 and its blade 41 (see FIG. 1) form a part thereof.

In this embodiment, the paddle 40 is connected to the shaft 20 to form the shoulder 11 of the stick 10. More particularly, the paddle 40 is attached to the shaft 20 via the dampening element 30. Accordingly, in this embodiment the connection of the paddle 40 to the outer surface 21 of the shaft 20 occurs via the dampening element 30, which makes the dampening element 30 a permanent fixture of the stick 10 that cannot be removed. However, as mentioned above, in an alternate embodiment whereby the dampening element 30 is removable from the shaft 20 of the stick 10, the dampening element 30 may not extend within the paddle and thus is not permanently fixed to the stick. Rather, in this alternate embodiment, the dampening element 30 may be formed as a sleeve which is removably received, for example, over the shaft 20 of the stick only (e.g. only extending along length L as shown in FIG. 2). As such, the dampening element 30 is a separate, removable, element not integrally or permanently fixed within the stick and thus permitting removal/replacement of the damping element 30 when desired.

Figure 3:
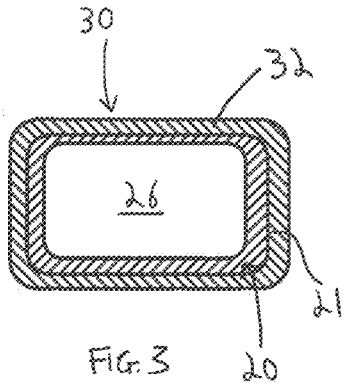
FIG. 3 is a cross-sectional view of the ice hockey goalie stick of FIGS. 1 and 2, taken along the line III-III in FIG. 2.
Figure 4:
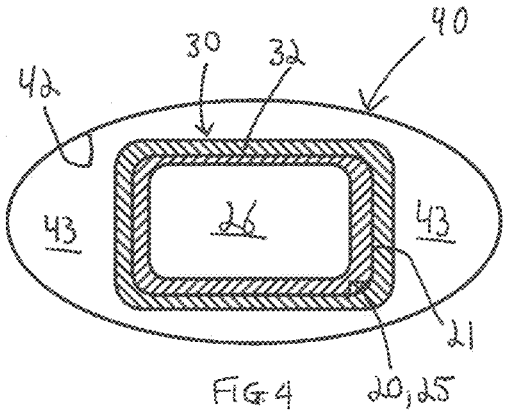
FIG. 4 is a cross-sectional view of the ice hockey goalie stick of FIG. 1, taken along the line IV-IV in FIG. 2.

As seen in FIGS. 4 and 5, the paddle 40 has an inner surface 42 which surrounds the entirety of the outer surface 21 covered by the dampening element 30. The length over which the paddle 40 surrounds the outer surface 21 covered by the dampening element 30 can vary. For example, the paddle 40 can surround only part of the dampening element 30 along length L, such that the paddle 40 connects to the shaft 20 at the lowest extremity of the dampening element 30 along length L. The paddle 40 can also surround the dampening element 30 along all of the additional length $L_2$ of the covered portion 25, such that the paddle 40 connects to the shaft 20 along the covered portion 25. Irrespective of the length over which the inner surface 42 of the paddle 40 surrounds the shaft 20 covered by the dampening element 30, the inner surface 42 of the paddle 40 is joined to the outer surface 21 of the shaft 20 by the dampening element 30. The overlapping of the paddle 40, the dampening element 30, and the shaft 20 is now explained in greater detail with reference to FIGS. 2 and 3.

The coverage of the dampening element 30 over the outer surface 21 of the shaft 20 is better shown in FIG. 3, which shows a cross section taken along a portion of the stick away from the paddle. The shaft 20 in FIG. 3 is hollow, and has a void 26 in its center. The vibration-dampening material 32 of the dampening element 30 surrounds and covers the entire periphery of the outer surface 21 of the shaft 20. The vibration-dampening material 32 is also exposed to view, such that the goalie can grip the vibration-dampening material on its outer face. It can thus be appreciated that dampening element 30 is disposed, at least in part, on the exterior of the stick, and is thus easy to grip. This is in contrast to some prior art sticks where the dampening mechanism or material is entirely within the stick.

The coverage of the paddle 40 over the dampening element 30 and over the outer surface 21 of the shaft 20 is better shown in FIG. 4, which shows a cross section taken along a portion of the paddle 40. The cross section of the covered portion 25 of the shaft 20 (i.e. the portion of the shaft 20 within the paddle 40) is shown in FIG. 4. The shaft 20 is hollow, and has the void 26 in its center. The paddle 40 is also hollow, and has a paddle void 43 surrounding the dampening element 30 and the shaft 20. The vibration-dampening material 32 of the dampening element 30 surrounds and covers the entire periphery of the outer surface 21 of the covered portion 25 of the shaft 20. The vibration-dampening material 32 is itself surrounded and covered by the inner surface 42 of the paddle 40.

The inner surface 42 of the paddle 40 is not in direct contact with the exterior of the vibration-dampening material 32 in FIG. 4. The paddle 40 may be overmolded over some or all of the additional length of the covered portion 25, with a fastener or other mechanical device connecting the exterior of the vibration-dampening material 32 to the inner surface 42 of the paddle 40. The dampening element 30 and the shaft 20 are thereby joined to the paddle 40. Alternatively, the vibration-dampening material 32 can be in direct contact with the inner surface 42 of the paddle 40 to join the dampening element 30 and the shaft 20 to the paddle 40.

The cross section of the stick taken in the plane shown in FIG. 4, which is transverse to the longitudinal axis of the stick, therefore shows the various layers or cores of the stick at any given point along the covered portion 25. More particularly, the cross section has an inner core defined by the shaft 20, a middle core defined by the dampening element 30 in direct contact with the outer surface 21 of the shaft inner core, and an outer core defined by the paddle 40 surrounding both the middle and inner cores.

The three pieces that make up the stick 10 and their relationship with one another are better shown in the exploded view of FIG. 5. The assembly of the components of the stick 10 can be understood as follows: a length of the shaft 20 is inserted into the dampening element 30 or covered thereby, and a length of the shaft 20 covered by the dampening element 30 is then inserted into the paddle 40 or covered thereby.

The covered portion 25 of the shaft 20 is shown in FIG. 5 as being exposed (i.e. not covered by the paddle 40). In the embodiment wherein the dampening element extends within the paddle and is thus not removable from the stick, the covered portion 25 will be covered by a lower segment 33 of the dampening material 30 during manufacture of the stick, and by the inner surface 42 of the paddle 40. The covered portion 25 of the shaft 20 extends towards the second end 24 of the shaft 20.

The covered portion 25 of the shaft 20 may have a width W which increases along a length of the covered portion 25 towards the second end 24 of the shaft 20. The covered portion 25 therefore flares outwardly away from the longitudinal axis of the shaft 20, and forms a wedge within the paddle 40. The covered portion 25 of the shaft therefore helps to reinforce the paddle 40. As shown in FIG. 5, the lower segment 33 of the dampening element 30, which covers the covered portion 25 with the vibration-dampening material 32, can be shaped similarly to the covered portion 25.

The remaining length of the shaft 20 outside the paddle 40 is an uncovered portion 27. The uncovered portion 27 is not covered by the inner surface 42 of the paddle 40, but some of its length is covered by the dampening element 30. More particularly, the uncovered portion 27 may have an upper section 28 extending along an upper section length, and a lower section 29 extending along a lower section length. The width of the lower section 29 is less than the width of the upper section 28 along their respective lengths. The outer surface 21 of the lower section 29 therefore has a smaller periphery than the outer surface 21 of the upper section 28. Stated differently, the lower section 29 is a thinner portion of the shaft 20 than the upper section 28.

An upper segment 34 of the dampening segment 30 can be fitted over the narrower lower section 29 of the uncovered portion 27. In such a configuration, the dampening element 30 extends over the outer surface 21 of the shaft 20 along the lower section 29 of the uncovered portion 27, and the vibration-dampening material 32 covers the outer surface 21 of the lower section 29 of the shaft 20. Since the covered portion 25 and the lower segment 33 are within the paddle 40 in the depicted embodiment, they are both hidden from view. The lower section 29 and the upper segment 34, in contrast, are not within the paddle 40 and are thus exposed to view. The lower section 29 covered by the upper segment 34 of the dampening element 30 can therefore be gripped by the hand of the goalie. The upper segment 34 of the dampening element 30 covering the lower section 29 of the shaft 20 therefore provides vibration reduction directly to the goalie, and may improve her/his grip on the stick 10. In this embodiment, the lower portion 33 of the dampening element 30 extends within and is covered by the paddle 40, such that this portion is sandwiched between the paddle 40 and the shaft 20 to provide a damped interconnection therebetween.

Additionally, and alternately, there may be a difference in length L between the dampening element 30 and the lower section 29 of the shaft. In this alterative, for example, the dampening element 30 may be shorter than the length of the lower section 29 of the shaft. This may be desirable as it will provide a ridge at the upper end of the lower section 29 of the shaft, and possibly a gap between this ridge and the upper segment 34 of the dampening element 30, which may be desirable to form an improved grip portion for the goalie. Similarly, such a ridge and/or gap may also be provided (either instead of or in addition to that at the upper end) at the opposite, or lower end, of the dampening element (i.e. between the dampening element and the junction between the shaft 20 and the paddle 40).

The upper segment 34 of the dampening element 30 can be flush with the upper section 28 of the shaft 20, and with the paddle 40. More particularly, the thickness of the vibration-dampening material 32 covering the outer surface 21 of the lower section 29, added to the width of the lower section 29, is substantially equal to the width of the upper section 28. This ensures a smooth transition along the length of the stick 10 between the upper section 28 of the shaft 20, which does not include the vibration-dampening material 32, and the lower section 29 of the shaft 20 which does. The hand of the goalie can therefore freely move between the upper and lower sections 28,29 without encountering bumps of impediments.

Referring to FIG. 5, there is also provided a method for making an ice hockey goalie stick 10. The method allows for the assembly of three different pieces (the shaft 20, the dampening element 30, and the paddle 40) by joining them together to make an integral stick 10. In most instances, the three pieces are joined in a molding process and cured in one molding cycle. Such a process facilitates customizing features of the stick 10 by using the correct molding pieces. For example, the molding process allows changing the curve pattern of the blade, the shape of the paddle 40, the geometry of the shaft 20, etc. with the same mold by simply using the correct insert.

The method includes covering a length of the shaft 20 with the dampening element 30, the dampening element 30 being made of the vibration-dampening material 32. The length of the shaft 20 covered by the vibration-dampening material 32 can be such that a portion of the vibration-dampening material 32 is within the paddle 40, while another portion of the vibration-dampening material 32 is exposed to be gripped by the goalie. The technique used to apply the vibration-dampening material 32 to the outer surface 21 of the shaft 20 will depend on the nature of the vibration-dampening material 32. For example, if the vibration-dampening material 32 is a polymer coating, it will be coated onto the length of the outer surface 21. If the vibration-dampening material 32 is a rubber sleeve, it will be pulled over the length of the outer surface 21 of the shaft 20.

The method also includes surrounding at least part of the length of the covered shaft 20 with the paddle 40. The covered shaft 20 includes the shaft 20 itself, as well as the length of the shaft 20 covered by the dampening element 30. The part of the shaft 20 covered by the paddle 40 is the covered portion 25. The remaining length of the shaft 20 which is not covered by the paddle 40, and which is thus exposed to be gripped by the goalie, is the uncovered portion 27. As explained above, a part of the uncovered portion 27 is covered by the vibration-dampening material 32. The vibration-dampening material 32 along this part of the uncovered portion 27 can be fuse bonded with the outer surface 21 of the shaft 20. The covered portion 25 within the paddle 40 can increase in width towards the second end 24 of the shaft 20, so as to reinforce the structure of the paddle 40.

The method also includes joining the paddle 40 to the dampening element 30 and to the shaft 20, thereby making the goalie stick 10. If a molding process is used to join the paddle 40 to the covered portion 25 of the shaft 20, the paddle 40 can be overmolded onto the vibration-dampening material 32 along the covered portion 25. Overmolding includes laying layers of prepreg over the vibration-dampening material 32 on the covered portion 25, and curing this assembly together. The molding process may also include compacting the covered portion 25 and the vibration-dampening material 32 inside the paddle 40, such as with an expandable mandrel.

In can thus be appreciated that the goalie stick 10 disclosed herein dampens the vibrations felt by the goalie when the puck impacts the stick 10, and may also improve the goalie's grip of the stick 10. In contrast to some other sporting sticks, goalie sticks are typically held with only one hand (the other hand wearing a glove). Therefore, one of the goalie's hands spends almost the entire match gripping the same spot on the stick (i.e. the shoulder). The stick 10 disclosed herein provides vibration dampening at least at this very part of the stick, thereby minimising the vibration transmitted to the goalie's hand when the puck impacts the stick 10. Over the course of an entire match, the goalie's ability to grip and manipulate the stick 10, and thus her/his performance, may be improved.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

The invention claimed is:

1. An ice hockey goalie stick, comprising:

a shaft extending along a longitudinal axis between a first end and an opposed second end, the shaft having an outer surface;

a paddle mounted to the shaft at said second end, the paddle extending along the longitudinal axis and terminating in a blade; and a dampening element disposed over at least a portion of the outer surface of the shaft, the dampening element surrounding at least a partial length of the shaft adjacent the second end of the shaft, the dampening element being made of a vibration-dampening material and covering the outer surface along said partial length, said partial length extending within the paddle and being covered thereby to define a covered portion of the shaft, a remaining length of the shaft outside the paddle being an uncovered portion of the shaft, the covered portion having a width which increases along said partial length towards the second end of the shaft.

2. The ice hockey goalie stick of claim 1, wherein the dampening element forms an exposed hand-grip region of the ice hockey goalie stick composed of the vibration-dampening material.

3. The ice hockey goalie stick of claim 1, wherein the paddle has an inner surface surrounding the covered portion of the shaft, the inner surface of the paddle being joined to the outer surface of the shaft by the dampening element, to provide a damped interconnection between the paddle and the shaft.

4. The ice hockey goalie stick of claim 1, wherein a cross section of the goalie stick is taken in a plane transverse to the longitudinal axis at a point within said partial length of the shaft, the cross section having an inner core defined by the shaft, a middle core defined by the dampening element covering the inner core, and an outer core defined by the paddle covering both the middle and inner cores.

5. The ice hockey goalie stick of claim 1, wherein the uncovered portion has an upper section extending along an upper section length, and a lower section extending along a lower section length, a width of the lower section along the lower section length being less than a width of the upper section along the upper section length.

6. The ice hockey goalie stick of claim 5, wherein the dampening element extends over the outer surface of the shaft along the lower section of the uncovered portion, the vibration-dampening material covering the outer surface of the lower section of the shaft.

7. The ice hockey goalie stick of claim 6, wherein a thickness of the vibration-dampening material covering the outer surface of the lower section added to the width of the lower section are substantially equal to the width of the upper section.

8. The ice hockey goalie stick of claim 1, wherein the dampening element is a rubber sleeve removably attached to the shaft.

9. The ice hockey goalie stick of claim 1, wherein the dampening element comprises a polymer coating applied to said partial length of the shaft.

10. The ice hockey goalie stick of claim 1, wherein the shaft and paddle are hollow along at least a portion of their respective lengths.

11. A method for making an ice hockey goalie stick, comprising:

covering at least a partial length of a shaft with a dampening element, the dampening element being made of a vibration-dampening material;

surrounding at least part of the dampening element on the shaft with a paddle to define a covered portion of the shaft, and increasing a width of the covered portion over its length; and joining the paddle to at least one of the dampening element and the shaft.

12. The method of claim 11, wherein the steps of covering and surrounding including forming an exposed hand-grip region of the ice hockey goalie stick from the vibration-dampening material by extending the dampening element along the shaft such that a portion of the dampening element is uncovered by the paddle.

13. The method of claim 11, wherein joining the paddle to at least one of the dampening element and the shaft includes fusing the dampening element to the shaft at a point along the partial length thereof.

14. The method claim 11, wherein joining the paddle to at least one of the dampening element and the shaft includes overmolding the paddle onto the vibration-dampening material on the shaft.

15. The method claim 11, wherein covering at least the partial length of the shaft with the dampening element includes coating the partial length of the shaft with the vibration-dampening material.

16. The method of claim 11, wherein covering at least the partial length of the shaft with the dampening element includes applying a rubber sleeve over the partial length of the shaft.

17. An ice hockey goalie stick, comprising:

a shaft having an outer surface and extending along a longitudinal axis between a first end and an opposed second end, the shaft having a handle portion proximate to the first end and an adjacent intermediate portion, the intermediate portion having a dampening element extending over the outer surface of the shaft along at least a portion of a length of the intermediate portion, the dampening element being made of a vibration-dampening material, the vibration-dampening material covering said portion of the length of the intermediate portion; and a paddle extending along the longitudinal axis and terminating in a blade, the paddle connected to the intermediate portion of the shaft;

wherein said portion of the length of the intermediate portion and the second end of the shaft extend within the paddle to define a covered portion of the shaft, a remaining length of the shaft outside the paddle being an uncovered portion, the covered portion having a width which increases along a length of the covered portion towards the second end.

18. The ice hockey goalie stick of claim 17, wherein the uncovered portion has an upper section extending along an upper section length, and a lower section extending along a lower section length, a width of the lower section along the lower section length being less than a width of the upper section along the upper section length.

19. The ice hockey goalie stick of claim 18, wherein the dampening element extends over the outer surface of the shaft along the lower section of the uncovered portion, the vibration-dampening material covering the outer surface of the lower section of the shaft.

20. The ice hockey goalie stick of claim 19, wherein a thickness of the vibration-dampening material covering the outer surface of the lower section added to the width of the lower section are substantially equal to the width of the upper section.

21. The ice hockey goalie stick of claim 17, wherein the dampening element is a rubber sleeve removably attached to the shaft.

22. The ice hockey goalie stick of claim 17, wherein the dampening element comprises a polymer coating.

23. The ice hockey goalie stick of claim 17, wherein the shaft and paddle are hollow along at least a portion of their respective lengths.

* * * * *